US005435277A

United States Patent [19]

Takahashi

[11] Patent Number: 5,435,277

[45] Date of Patent: Jul. 25, 1995

[54] HOT WATER INJECTION APPARATUS FOR WATER COOLING ENGINE

[75] Inventor: Nobuo Takahashi, 1-8, Ishigakihigashi 3-chome, Beppu-shi, Oita-ken, Japan

[73] Assignees: Nobuo Takahashi, Oita; Zojirushi Corporation, Osaka, both of Japan

[21] Appl. No.: 30,548

[22] Filed: Mar. 12, 1993

[51] Int. Cl.[6] ..... F01P 11/20; F02N 17/02

[52] U.S. Cl. ..... 123/142.5 E; 123/41.14; 123/179.21

[58] Field of Search ..... 123/179.21, 41.14, 142.5 R, 123/142.5 E

[56] References Cited

U.S. PATENT DOCUMENTS

| | | | |
|---|---|---|---|
| 2,401,510 | 6/1946 | Rowley | 123/41.14 |
| 3,498,539 | 3/1970 | Boehmfeld et al. | 123/41.14 |
| 3,853,270 | 12/1974 | Prebil | 123/41.14 |
| 4,532,894 | 8/1985 | Wolf et al. | 123/142.5 E |
| 4,556,171 | 12/1985 | Fukami et al. | 123/41.14 |
| 4,591,691 | 5/1986 | Badali | 123/192.5 E |

FOREIGN PATENT DOCUMENTS

| | | | |
|---|---|---|---|
| 0220595 | 4/1910 | Germany | 123/41.14 |
| 2913650 | 6/1980 | Germany | 123/41.14 |
| 63-247550 | 3/1987 | Japan . | |
| 63-5107 | 1/1988 | Japan . | |
| 63-73578 | 5/1988 | Japan . | |
| 63-75525 | 5/1988 | Japan . | |
| 0158930 | 2/1933 | Switzerland | 123/41.14 |
| 0139109 | 2/1920 | United Kingdom | 123/41.14 |
| 0415629 | 8/1934 | United Kingdom | 123/41.14 |

*Primary Examiner*—Henry C. Yuen
*Assistant Examiner*—Erick Solis
*Attorney, Agent, or Firm*—Birch, Stewart, Kolasch & Birch

[57] ABSTRACT

A hot water injection apparatus for a water cooling engine having a cooling water main circulation line and a cooling water bypass circulation line comprises a thermal insulation vessel which is vertically installed. The vessel has an inlet opening and an outlet opening of which level is higher than that of the inlet opening. The inlet opening and the outlet opening are connected in series to the bypass line. When the engine is started, the high temperature water stored in the vessel flows into the engine to accelerate the warming-up operation. During the normal operation, the warmed water which is obtained by mixing the low temperature water in the main line with the high temperature water in the bypass line, flows into the engine to promote the vaporization of the fuel when the engine is stopped, the high temperature water in the bypass line is stored in the vessel and is held at a high temperature.

7 Claims, 3 Drawing Sheets

HOT WATER INJECTION APPARATUS FOR WATER COOLING ENGINE

BACKGROUND OF THE INVENTION

1. Field of the Invention

The present invention relates to a hot water injection apparatus for a water cooling engine aiming to shorten a time of the warming-up operation, in which the density of the air-fuel mixture is high, so as to save the fuel consumption.

2. Description of the Prior Art

Conventional water cooling engine have a disadvantage that it takes a long time for the cooling water in the cylinder block to rise from a cooled condition to a heated condition during the warming-up operation. During the warming-up operation the density of the air-fuel mixture is maintained in a high condition by a mechanism, for example, an automatic choking mechanism until the temperature of the cooling water in the cylinder block rises to more than about 50 degrees.

Moreover, the uncombusted air-fuel mixture is exhausted during the warming-up operation especially in cold season, because the engine is governed at a high rotative speed by advancing the ignition timing in order to shorten a time of the warming-up operation. The uncombusted air-fuel mixture causes a pollution problem due to the hydrocarbon and does not enable an energy saving.

At a parking lot around a department store and a railroad station etc. a driver who leaves the car feels the irritation of his eyes or the stimulation of his nose or throat by a large quantity of the hydrocarbon exhausted from many cars under the warming-up operation. These conditions are typical for causing air pollution due to the hydrocarbon. It is experienced in cold season for a car that has come to a stop when it is driven without the warming-up operation, or that the engine was stalled due to a wet spark plug when the engine has been chocked too much.

Once the water cooled engine is stopped, the temperature of the cooling water heated by the engine during the operation falls to normal temperature taking about 30 minutes to 1 hour. Therefore the warming-up operation is repeated every time starting the engine. The car is now frequently used for the purpose of means for moving for a short time of 5 to 10 minutes, for example, for commuting, shopping and moving on business or leisure. In these circumstances, a car has a tendency to repeat such a warming-up operation several times a day in cold season.

Various apparatus have been proposed so far to store the high temperature cooling water heated by the engine during the normal operation and to make use of it for the next warm-up so as to shorten a time of the warming-up operation.

For example, laid open Japanese utility-model application No. U63-75525 discloses a water cooling system which is provided with a thermal insulation tank. The tank is situated in a bypass circulation line which returns the cooling water from a cooling water outlet of the engine to a cooling water inlet without passing through a radiator. A valve actuated in response to on and off of an ignition switch is fixed to an inlet and an outlet of the tank. Japanese patent application of laid-open No. P63-5107 discloses the same water cooling system with a thermos bottle as the aforementioned system except that the valve is actuated by an electromagnetic thermostat.

The disadvantage of the systems is that the fixation of the valves makes the valves control complex and make the systems expensive and that the same level of the inlet and the outlet of the tank prevents the cooling water stored in the tank from flowing out smoothly.

Japanese laid open utility-model application No. U63-73578 also discloses a water cooling system which is provided with a sealed thermal insulation tank. The tank is communicated to the water cooling line through a valve and is connected to a means for increasing and decreasing the internal pressure of the tank. When the engine is stopped, the cooling water is sucked in the tank and insulated. Then the engine is started, the cooling water is returned to the water cooling line. The disadvantage of the system is that the installation of the valve and the pressure increasing and decreasing means makes the system control complex and difficult.

Thus, having many disadvantages, the previous systems have not been put into practical use yet.

SUMMARY OF THE INVENTION

The present invention has been developed to substantially eliminate the above-described disadvantages.

It is an object of the present invention to provide a hot water injection apparatus for a water cooling engine which is simply constructed and is able to inject the stored cooling water in a high temperature into the cylinder block of the engine smoothly when the engine is started so that a time of the warming-up operation can be reduced in cold season.

In order to achieve the aforementioned object, there is provided a hot water injection apparatus for a water cooling engine having a cooling water main circulation line which opens at a predetermined temperature of a cooling water and leads a high temperature cooling water from the engine to a radiator and returns a low temperature cooling water cooled by the radiator from the radiator to the engine, and a cooling water bypass circulation line which returns the high temperature cooling water from the engine directly to the engine, without passing through the radiator, the apparatus comprising;

a thermal insulation vessel having an inlet opening and an outlet opening of which a level is higher than that of the inlet opening, the inlet opening and the outlet opening are connected in series to the bypass circulation line.

In the preferred embodiment, the bypass circulation line comprises a heating medium circulation line for an air conditioning unit, and the vessel is installed in the heating medium circulation line.

Preferably, the vessel has a double wall evacuated therebetween to hold a vacuum.

In another preferred embodiment, the inlet opening comprises an inlet nozzle which is provided in the lowest position of the vessel, and the outlet opening is formed in the upper portion of an internal outlet pipe which is inserted into the vessel. It is preferable that a partition wall of ring shape is fitted on the outside of the internal outlet pipe, and the partition wall is movable along the axis of the outlet pipe.

In still another preferred embodiment, the vessel is provided with an electric heater which is able to heat the low temperature cooling water stored in the vessel.

The present invention has the following advantages.

As the high temperature cooling water, which is stored in the vessel during the engine is stopped, flows into the engine and warms up the engine when the engine is started, a time of the warming-up operation is shortened especially in cold season.

During the warming-up operation, the wall temperature of the cylinder and the cylinder head becomes high due to the high temperature cooling water flowing in the engine, which accelerates the fuel vaporization and causes a perfect combustion and a non pollution of the exhaust gas.

In the normal operation, the warmed cooling water, which is obtained by mixing the low temperature cooling water in the main circulation line with the high temperature cooling water in the bypass circulation line, flows into the engine, whereby the acceleration of the fuel vaporization and the perfect combustion are accomplished in the same way as in the warming-up operation. Therefore the power is increased when the car runs in a low speed or climbs a grade. Moreover a noise of the engine and a pollution due to the exhaust gas is decreased.

The level of the outlet opening of the vessel is higher than that of the inlet opening. Therefore when the engine is stopped, the low temperature cooling water in the bypass circulation line does not flow into the vessel through the inlet opening and the high temperature cooling water stored in the vessel does not flow out the vessel through the outlet opening, whereby the cooling water stored in the vessel is maintained in a high temperature. Moreover when the engine is started, the high temperature cooling water stored in the vessel is pushed up by the low temperature cooling water flowing into from the inlet opening of the vessel. As a result no valve is required in the vessel, which makes the apparatus simple. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further objects and advantages of the present invention will become clear from the following description taken in conjunction with the preferred embodiments thereof with reference to the accompanying drawings.

DETAILED DESCRIPTION OF THE PREFERRED EMBODIMENTS

Figure 2:
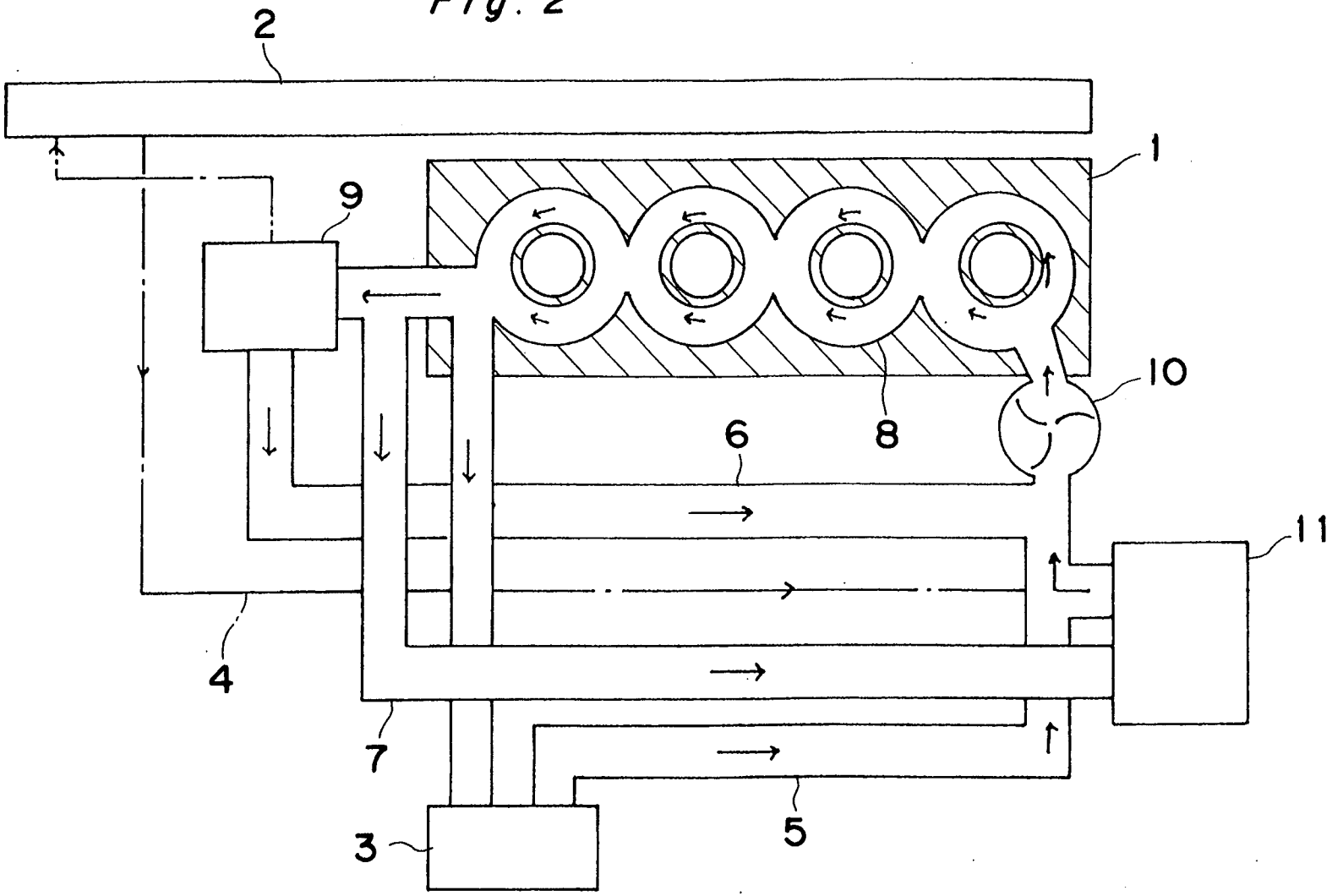
FIG. 2 is a water cooling system flow diagram with a vessel of the present invention.

FIG. 2 shows a water cooling system of an engine for a car with a hot water injection apparatus according to the present invention. The system includes an engine 1, a radiator 2 and a heater 3 for heating the passenger compartment. The water cooling system comprises a main circulation line 4, a heating medium circulation line 5 and a first and a second bypass circulation lines 6 and 7. The main circulation line 4 leads the cooling water from an outlet of a water jacket 8 formed in a cylinder and a cylinder head of the engine 1 to an inlet of the radiator 2 through a thermostat valve 9 and returns it from an outlet of the radiator 2 to an inlet of the water jacket 8 through a water pump 10. The heating medium circulation line 5 leads the cooling water from the outlet of the water jacket 8 to an inlet of the heater 3 and returns it from an outlet of the heater 3 to the inlet of the water jacket 8 through the water pump 10. The 1st and 2nd bypass circulation lines 6,7 returns the cooling water from the outlet of the water jacket 8 directly to the inlet of the water jacket 8 through the water pump 10.

Figure 1:
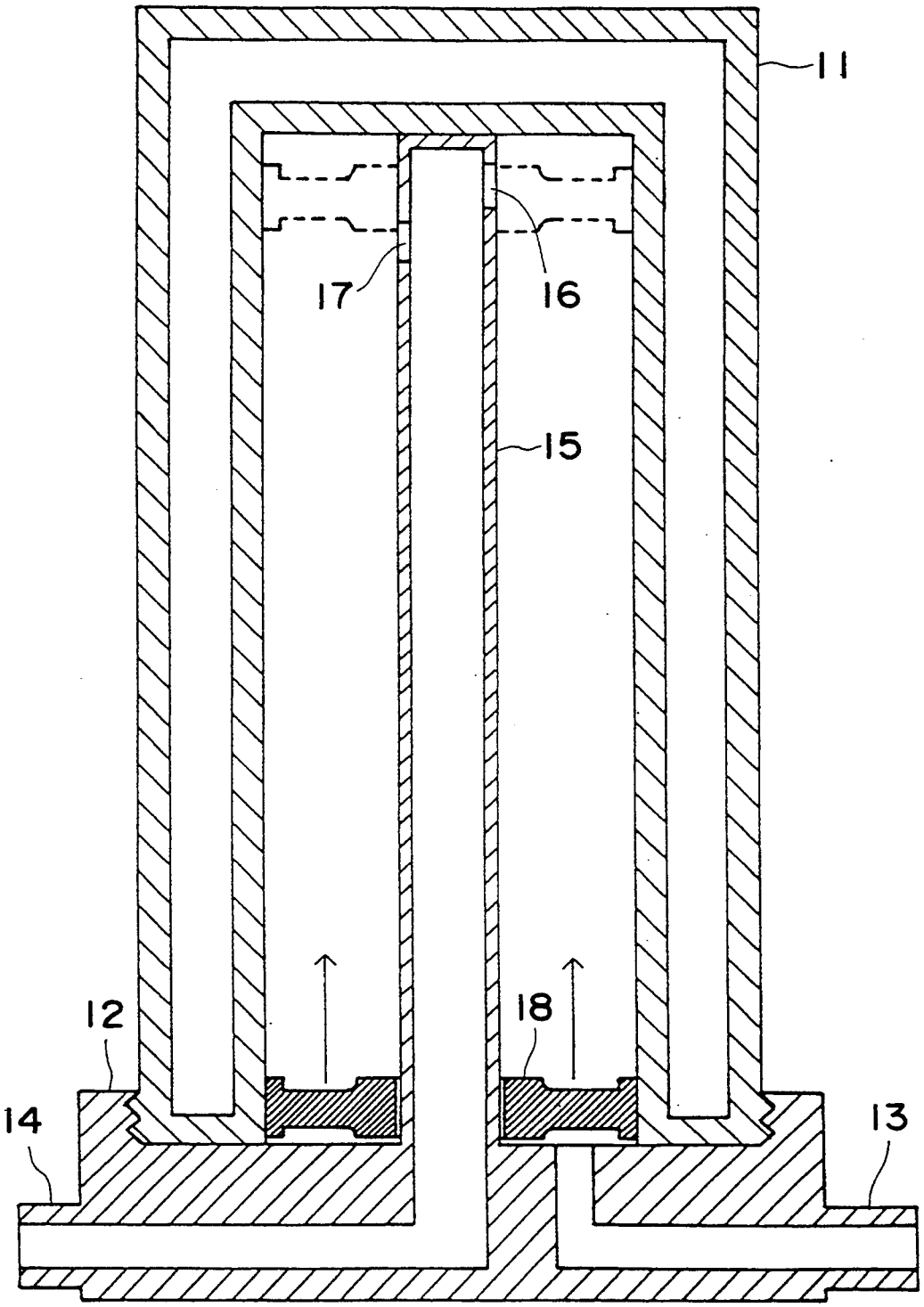
FIG. 1 is a sectional view of a preferred embodiment of the present invention.

The 2nd bypass circulation line 7 is provided with a thermal insulation vessel 11 upstream the water pump 10. As shown in FIG. 1, the vessel 11 has double walls evacuated therebetween to hold a vacuum. A thermos bottle is available for this vessel 11. The vessel 11 is installed on the body of the car so that the mouth of the vessel 11 can face downward. A cap 12 is screwed or welded to the mouth of the vessel 11. The cap 12 is provided with an inlet nozzle 13 and the outlet nozzle 14 protruded from the circumferential surface of the cap 12. The hole of the inlet nozzle 13 passes through the cap 12 and opens to the internal space of the vessel 11. The hole of the outlet nozzle 14 also passes through the cap 12 and opens to the internal space of an internal outlet pipe 15 which extends vertically along the longitudinal axis of the vessel 11 from the internal surface of the cap 12.

The upper end of the outlet pipe 15 is closed and contacted with the internal end surface of the vessel 11. A 1st outlet opening 16 and a 2nd outlet opening 17 are formed in the upper portion adjacent to the upper end of the outlet pipe 15. The level of the 2nd outlet opening 17 is slightly lower than that of the 1st outlet opening 16. A partition wall 18 of ring shape is fitted on the outside of the outlet pipe 15 and is movable along the axis of the outlet pipe 15.

The inlet nozzle 13 of the vessel 11 is connected to the outlet of the water jacket 8 through the 2nd bypass circulation line 7, while the outlet nozzle 14 of the vessel 11 is connected to the suction side of the water pump 10 through the 2nd bypass circulation line 7.

Alternatively, the vessel 11 may be installed in the downstream side of the water pump 10 of the 2nd bypass circulation line 7. Moreover, the vessel 11 can be installed in the 1st bypass circulation line 6 or in the heating medium circulation line 5.

The operation of the water cooling system with the thermal insulation vessel 11 described above is as follows.

When the engine 1 is started by the ignition switch (not shown), the water pump 10 rotates, which forces the cooling water in the water jacket 8 to flow out of the outlet of the water jacket 8. As the temperature of the cooling water is low at the start of the engine 1, the thermostat valve 9 is closed. Thus the low temperature cooling water passes through the heating medium circulation line 5 and the 1st and 2nd circulation line 6,7. When the low temperature cooling water flows into the inlet nozzle 13 of the vessel 11, the partition wall 18 moves upwardly by the dynamic pressure of the low temperature cooling water, causing the high temperature cooling water stored in the vessel 11 to flow into the outlet pipe 15 through the 1st and 2nd outlet opening 16, 17. The high temperature cooling water which passes through the outlet pipe 15 flows into the 2nd bypass circulation line 7 through the outlet nozzle 14 and then flows into the inside of water jacket 8 through the water pump 10.

The high temperature of the cooling water which passes through the water jacket 8 accelerates the warm-up of the engine 1. When the high temperature cooling water passes a round of the 1st bypass circulation line 6 and the heating medium circulation line 5 as well as the 2nd bypass circulation line 7, the warming-up operation is completed for a short time.

In a conventional water cooling system, the temperature of the cylinder wall is low at the start of the engine. Therefore the supercooled condition of the cylinder causes the fire-extinguishing action and suppresses the vaporization of the fuel and the flame propagation, which results in incomplete combustion. On the other hand, in the present invention, the cylinder is held at a high temperature by the high temperature cooling water. Therefore, the heated condition of the cylinder promotes the vaporization of the fuel, which results in complete combustion of the air-fuel mixture and the air pollution caused by the exhaust gas during the warming-up operation is reduced.

After the warm-up is completed and the cooling water rises to a predetermined temperature, the thermostat valve 9 is opened. Thus most of the high temperature cooling water flowing out of the water jacket 8 flows into the main circulation line 4 and passes through the radiator 2 in which the cooling water is cooled, whereby the low temperature cooling water is returned to the water jacket 8 through the main circulation line 4. A part of the high temperature cooling water flowing out of the water jacket 8 flows into the 2nd bypass circulation line 7 and passes through the vessel 11. The low temperature cooling water flowing out of the radiator 2 in the main circulation line 4 mixes with the high temperature cooling water flowing out of the vessel 11 in the 2nd bypass circulation line 7, so that the low temperature cooling water is warmed up to an appropriate temperature. Then, the warmed cooling water flows into the water jacket 8.

In the conventional water cooling system, the direct flow of the low temperature cooling water cooled by the radiator 2 into the water jacket 8 reduces the temperature of the cylinder wall adjacent to the inlet of the water jacket 8, which causes the fire-extinguishing action and suppresses the vaporization of the fuel. This results in that the temperature difference of the cylinder walls between the inlet side and the outlet side arises, whereby a noise occurs when the car accelerates or climbs a grade and a knocking occurs at a low speed.

On the other hand, in the present invention, such a noise or a knocking does not occur, because the warmed cooling water which is obtained by mixing the low temperature cooling water in the main circulation line 4 with the high temperature cooling water in the 2nd bypass circulation line 7 flows into the water jacket 8 so that the temperature of the cylinder wall adjacent to the inlet of the water jacket 8 increases and the temperature difference between the inlet and outlet sides decreases.

When the engine is stopped, the flow of the cooling water in each circulation line 4,5,6,7 halts and the temperature of the cooling water gradually decreases spontaneously. The cooling water in the vessel 11 of the 2nd bypass circulation line 7, however, is maintained in a high temperature condition as stored by the action of the vacuum insulation. The partition wall 18 in the vessel 11 moves downward by it's own weight to sit on the cap 12 and there serves as a insulation to improve the insulation efficiency of the vessel 11.

The low level of the inlet nozzle 13 prevents the low temperature cooling water of a heavy specific gravity from flowing into the vessel 11. Moreover, the high level of the outlet opening 17 prevents the high temperature cooling water of a light specific gravity from flowing out of the vessel 11 through the outlet pipe 15.

It is preferable to provide the partition wall 18 for perfectly preventing the high temperature cooling water above the partition wall 18 from mixing with the low temperature cooling water under the partition wall 18. However, even if the partition wall 18 is not provided, the high temperature and low temperature cooling water does not mix with each other, because the specific gravity of the high temperature cooling water is smaller than that of the low temperature cooling water and the former pushes up the latter and forces it to flow out as remaining in a high temperature.

Figure 3:
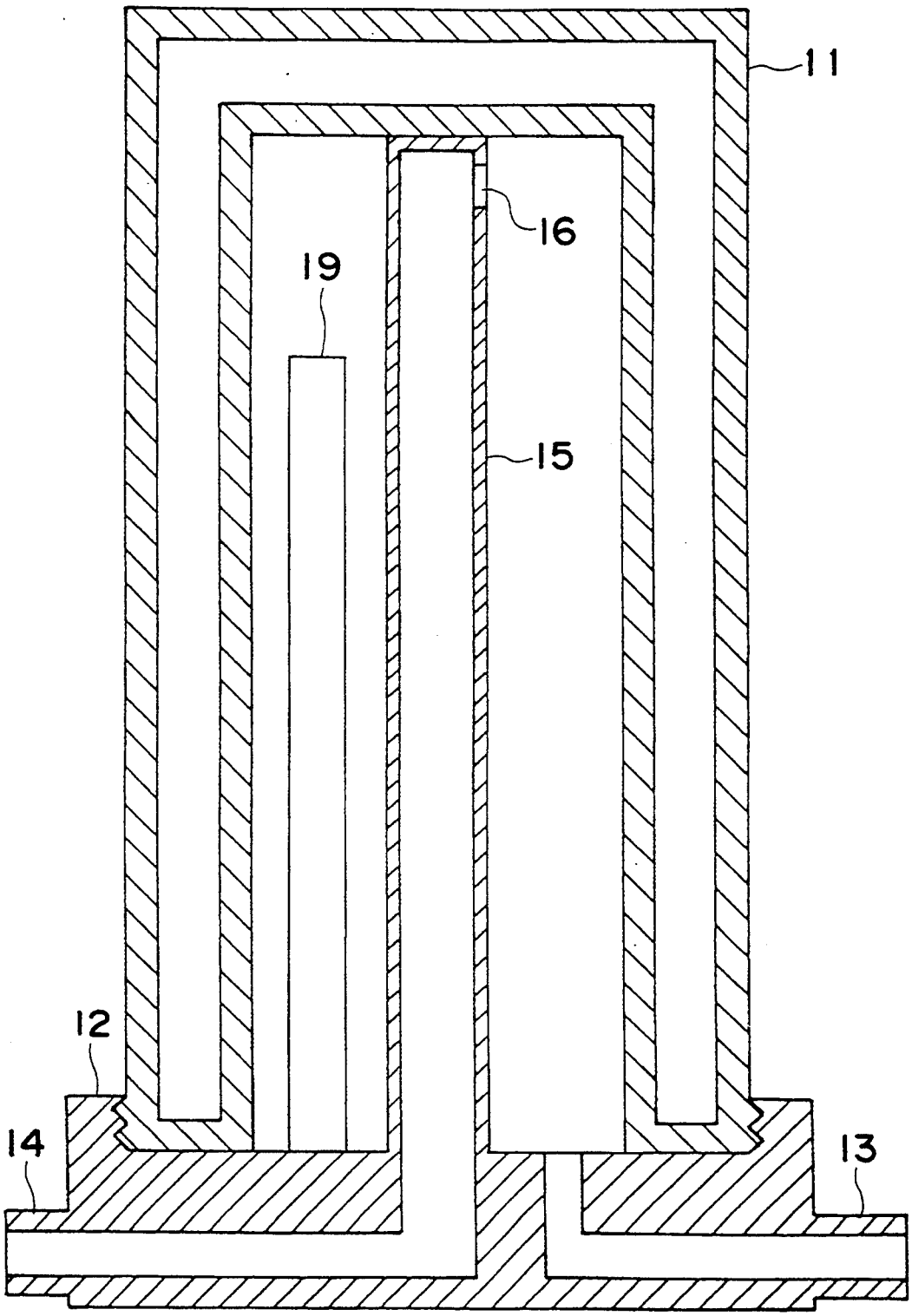
FIG. 3 is a sectional view of another preferred embodiment of the present invention.

The thermal insulation vessel 11 as aforementioned holds the cooling water stored therein in a high temperature condition for about 50 hours. However if the car is not used for a long time, for example, 1 week, the cooling water stored in the vessel 11 gets cold. Therefore, as shown in FIG. 3, it is preferable to provide the vessel 11 with a electric heater 19.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. A hot water injection apparatus for a water cooled engine having a cooling water main circulation line which opens at a predetermined temperature of a cooling water and leads a high temperature cooling water from said engine to a radiator and returns a low temperature cooling water cooled by said radiator from said radiator to said engine, and a cooling water bypass circulation line which returns said high temperature cooling water from said engine directly to said engine without passing through said radiator, said apparatus comprising;

a thermal insulation vessel having an inlet opening and an outlet opening of which level is higher than that of said inlet opening, said inlet opening and said outlet opening are connected in series to said bypass circulation line;

wherein said inlet opening comprises an inlet nozzle which is provided in a lowest position of said vessel, and said outlet opening is formed in an upper portion of an internal outlet pipe which is inserted into said vessel and;

wherein a partition wall is fitted on an outside of said internal outlet pipe, said partition wall being movable along an axis of said outlet pipe.

2. The apparatus of claim 1, wherein said bypass circulation line comprises a heating medium circulation line for heating a passenger compartment of a vehicle, and said vessel is installed in said heating medium circulation line.

3. The apparatus of claim 1, wherein said vessel has a double wall construction which is evacuated therebetween.

4. The apparatus of claim 1, wherein said vessel is provided with an electric heater for heating cooling water stored in said vessel.

5. A hot water injection apparatus for a water cooled engine, comprising:

a thermal insulation vessel, said thermal insulation vessel having an inlet opening;

an elongated internal outlet pipe disposed within said internal insulation vessel, said elongated internal outlet pipe having an outlet opening formed in an upper portion thereof; and a partition wall fitted on an outside of said internal outlet pipe, said partition wall being movable along an axis of said outlet pipe.

6. The apparatus of claim 5, wherein said vessel has a double wall construction which is evacuated therebetween.

7. The apparatus of claim 5, wherein said vessel is provided with an electric heater for heating cooling water stored in said vessel.

* * * * *